US009045869B2

(12) United States Patent
Biernacki et al.

(10) Patent No.: US 9,045,869 B2
(45) Date of Patent: Jun. 2, 2015

(54) SCREED SYSTEM

(75) Inventors: Andrzej Robert Biernacki, Coquitlam (CA); Waldemar Domzal, Anmore (CA)

(73) Assignee: Andrzej R. Biernacki, Coquitlam, British Columbia (CA)

( * ) Notice: Subject to any disclaimer, the term of this patent is extended or adjusted under 35 U.S.C. 154(b) by 0 days.

(21) Appl. No.: 13/546,839

(22) Filed: Jul. 11, 2012

(65) Prior Publication Data

US 2013/0183095 A1 Jul. 18, 2013

(30) Foreign Application Priority Data

Jul. 11, 2011 (CA) ..... 2746681

(51) Int. Cl.

| | |
|---|---|
| ***E01C 19/48*** | (2006.01) |
| ***E04F 21/24*** | (2006.01) |
| ***E01C 19/18*** | (2006.01) |
| ***E01C 19/44*** | (2006.01) |

(52) U.S. Cl.

CPC ..... *E01C 19/4866* (2013.01); *E04F 21/24* (2013.01); *E01C 19/187* (2013.01); *E01C 19/44* (2013.01)

(58) Field of Classification Search

CPC ... E01C 19/4866; E01C 19/187; E01C 19/44; E04F 21/24

USPC ..... 404/118, 119, 120

See application file for complete search history.

(56) References Cited

U.S. PATENT DOCUMENTS

| | | | | |
|---|---|---|---|---|
| 2,306,671 | A | 12/1942 | Tamblyn | |
| 2,486,422 | A | 11/1949 | Kies | |
| 2,825,152 | A * | 3/1958 | Baylon | 434/430 |
| 3,417,679 | A * | 12/1968 | Crayton | 404/108 |
| 3,448,875 | A * | 6/1969 | Robinson, Jr. | 414/542 |
| 4,132,492 | A | 1/1979 | Jenkins | |
| 4,614,063 | A | 9/1986 | Crivaro et al. | |
| 4,822,210 | A | 4/1989 | Oury et al. | |
| 5,156,487 | A * | 10/1992 | Haid | 404/72 |
| 5,190,396 | A | 3/1993 | Aoyagi et al. | |
| 5,224,793 | A * | 7/1993 | De Pol et al. | 404/119 |
| 5,257,764 | A | 11/1993 | Spaulding | |
| 5,388,927 | A * | 2/1995 | Ulmer et al. | 404/84.5 |
| 5,609,437 | A * | 3/1997 | Silva | 404/118 |
| 5,807,022 | A * | 9/1998 | McCleary | 404/97 |
| 6,398,453 | B1 * | 6/2002 | Stegemoeller | 404/108 |
| 6,550,214 | B2 | 4/2003 | Aguilera | |
| 6,981,819 | B1 * | 1/2006 | Suckow et al. | 404/114 |
| 7,018,133 | B2 | 3/2006 | Peterson | |
| 7,048,530 | B2 * | 5/2006 | Gaillard et al. | 425/258 |
| 7,192,216 | B2 * | 3/2007 | Casale | 404/118 |
| 7,478,973 | B2 | 1/2009 | Brotzel | |
| 7,877,889 | B2 * | 2/2011 | Griffin, Jr. | 33/562 |
| 7,891,906 | B2 | 2/2011 | Quenzi et al. | |
| 8,104,992 | B2 * | 1/2012 | Biodrowski | 404/118 |
| 2008/0253836 | A1 | 10/2008 | Bohse | |
| 2009/0158682 | A1 * | 6/2009 | Arnold | 52/364 |
| 2009/0226257 | A1 | 9/2009 | Lindley | |
| 2010/0038041 | A1 * | 2/2010 | Liao | 160/196.1 |
| 2010/0221067 | A1 * | 9/2010 | Kahle | 404/75 |

* cited by examiner

*Primary Examiner* — Thomas B Will
*Assistant Examiner* — Jessica H Lutz
(74) *Attorney, Agent, or Firm* — LeClairRyan, a Professional Corporation

(57) ABSTRACT

A screed system, having: a first elevatable rail; a second elevatable rail; a screed bar positioned below the first and second rails and supported by the first and second elevatable rails by respective first and second rotatable hinges, the screed bar moveable along the first and second rails and rotatable relative to the first and second rails at both the respective first and second rotatable hinges.

13 Claims, 5 Drawing Sheets

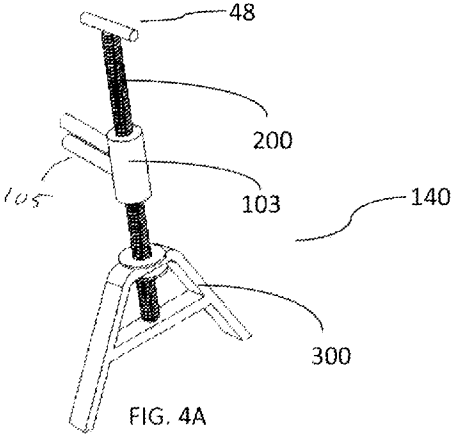
FIG. 4A
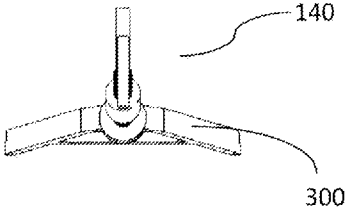
FIG. 4B
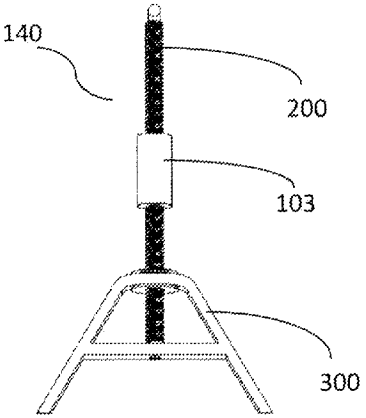
FIG. 4C
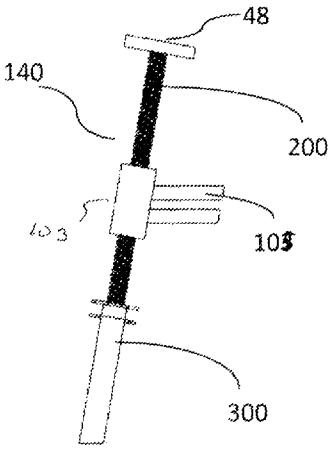
FIG. 4D
FIG. 4

SCREED SYSTEM

RELATED APPLICATION

The present application claims the benefit of priority under 35 U.S.C. 119 on Canadian Patent Application Serial No. 2,746,681, filed Jul. 11, 2011, and entitled "Screed System and Method", all commonly owned herewith.

TECHNICAL FIELD

This present disclosure relates to the general field of screed systems and more particularly for systems for levelling and finishing poured concrete.

BACKGROUND

Finishing and levelling poured concrete surfaces is a costly and time consuming task in both new and old construction. In buildings, such as condominiums, high rises, etc., the concrete must be finely levelled and ground. The shape of the rooms and hallways in such buildings make the use of standard screeds (which typically include a single screed bar movable in a single direction), difficult as parts of a unit, such as closets, become very difficult to reach. Another alternative is to use a handheld screed, but these are time consuming and have imprecise results.

Related prior art include: U.S. Pat. Nos. 2,306,671; 2,486,422; 4,132,492; 4,614,063; 4,822,210; 5,190,396; 5,257,764; 5,609,437; 6,550,214; 7,018,133; 7,478,973; and 7,891,906; and U.S. patent application Ser. Nos. 11/735,805 and 12/400,585.

SUMMARY

A screed system, having: a first elevatable rail; a second elevatable rail; a screed bar positioned below the first and second rails and supported by the first and second elevatable rails by respective first and second rotatable hinges, the screed bar moveable along the first and second rails and rotatable relative to the first and second rails at both the respective first and second rotatable hinges. The screed system is adjustable to the width and shape of the layout of the building.

The screed bar may have a rubber blade, and the elevatable rails, and screed bar may have adjustable lengths.

The rails may each include first and second rail bars, each of the rails bars slidably engaged and moveable along each other.

The screed bar may include a main screed bar aligned with and adjacent to first and second extension screed bars slidably moveable along said main screed bar. The main screen bar may include a handle.

Each of said rotational hinges may include a slidable rail head positionable along the rail, the rail head supporting a thrust bearing having a female hinge. The rail head may be secured to the rail by pins and inserts, the inserts sized to be insertable and supported by grooves on a bottom side of the rail. The rails may include a plurality of rollers to assist slidable movement of the rail head, and the female hinge may hold and support a male hinge, the male hinge secured to a screed head slidingly positionable along the screed bar.

The may be supported at their ends by a height adjustable stand. The rails may be supported by a reinforcement bar at a top of each rail. The screed bar may be detachable from the rotatable hinges. A plurality of level heads may be positioned on said rails.

BRIEF DESCRIPTION OF THE DRAWINGS

Embodiments will be described with reference to the following drawings, in which like reference numerals denote like parts:

FIGS. 4*a* to 4*d* are perspective, top, side and front views of the stand shown in Detail B in FIG. 1, showing the stand used to support the screed system.

DETAILED DESCRIPTION

The embodiments of the present invention relate to a screed system 100 for levelling and finishing concrete.

Figure 1:
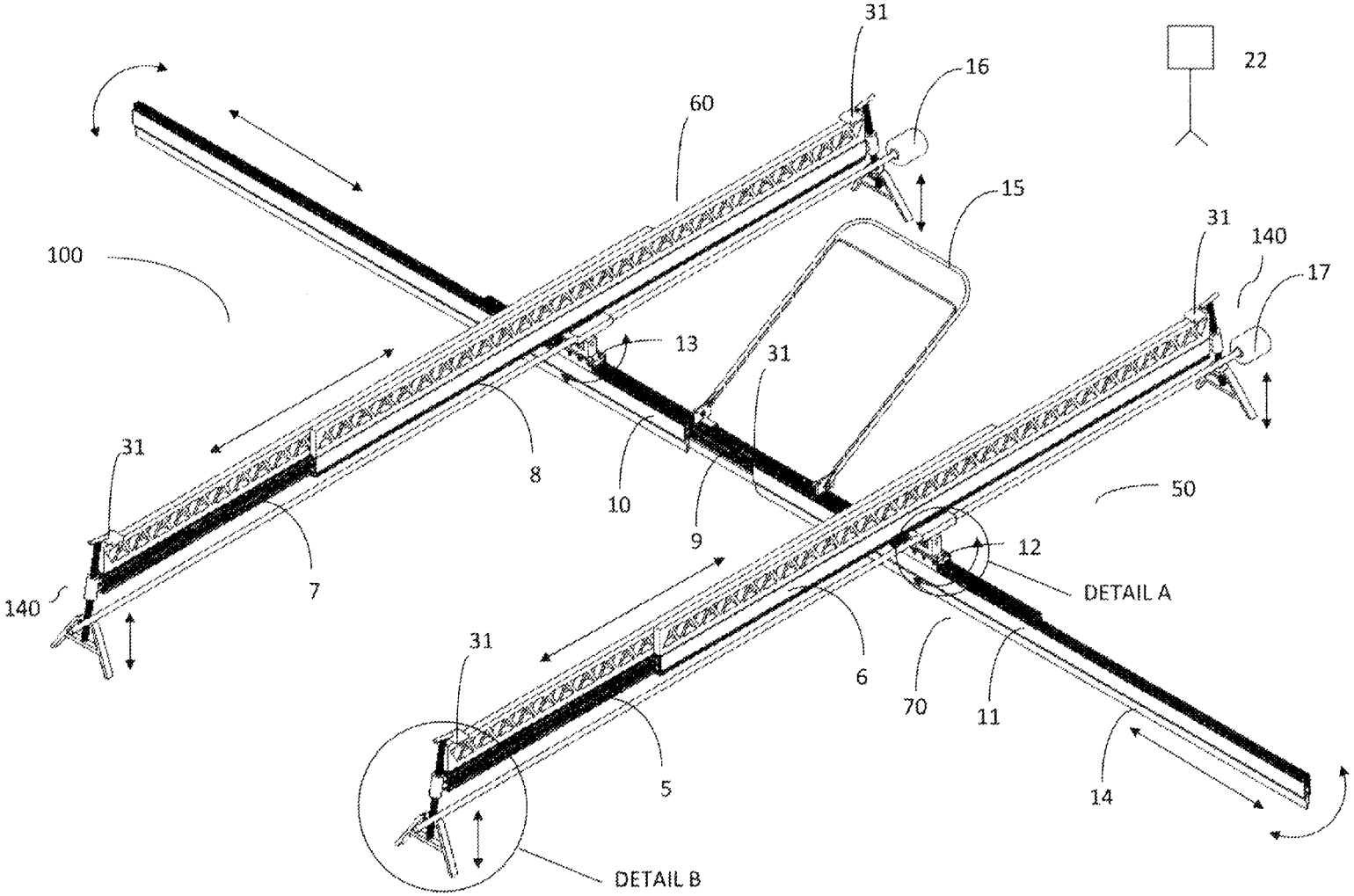
FIG. 1 is a perspective view of a screed system according to the invention.

With reference to FIG. 1, screed system 100 generally includes a first rail 50 having adjustable rail bars 5, 6 and a second rail 60 having adjustable rail bars 7, 8; and screed bar 70 including main screed bar 9 and extension screed bars 10, 11. First rail 50 and second rail 60 are usually positioned in a generally parallel fashion, although they need not be so. Screed bar 70 is supported below first and second rails 50, 60, at first and second rotational hinges 12, 13. Rails 50, 60 each include two slidingly connected rail bars 5, 6 and 7, 8 respectively, allowing rails 50, 60 to have an adjustable length.

Screed bar 70 includes main screed bar 9 and first and second extension screed bars 10, 11. Main screed bar 9 is fixed to each of rotational hinges 12, 13. Extension bars 10, 11 are moveable relative to main screed bar 9, thereby allowing screed bar 70 to lengthen and contract as needed to fit the space in which the concrete is to be levelled. Extension bars 10, 11 may have locking knobs or pins (not shown) to maintain them in position. Main screed bar 9 also includes handle 15, to allow a user to easily manipulate screed bar 70. The bottom of main screed bar 9 and extension bars 9, 10 have rubber blade 14, to contact and level the concrete.

Figure 2:
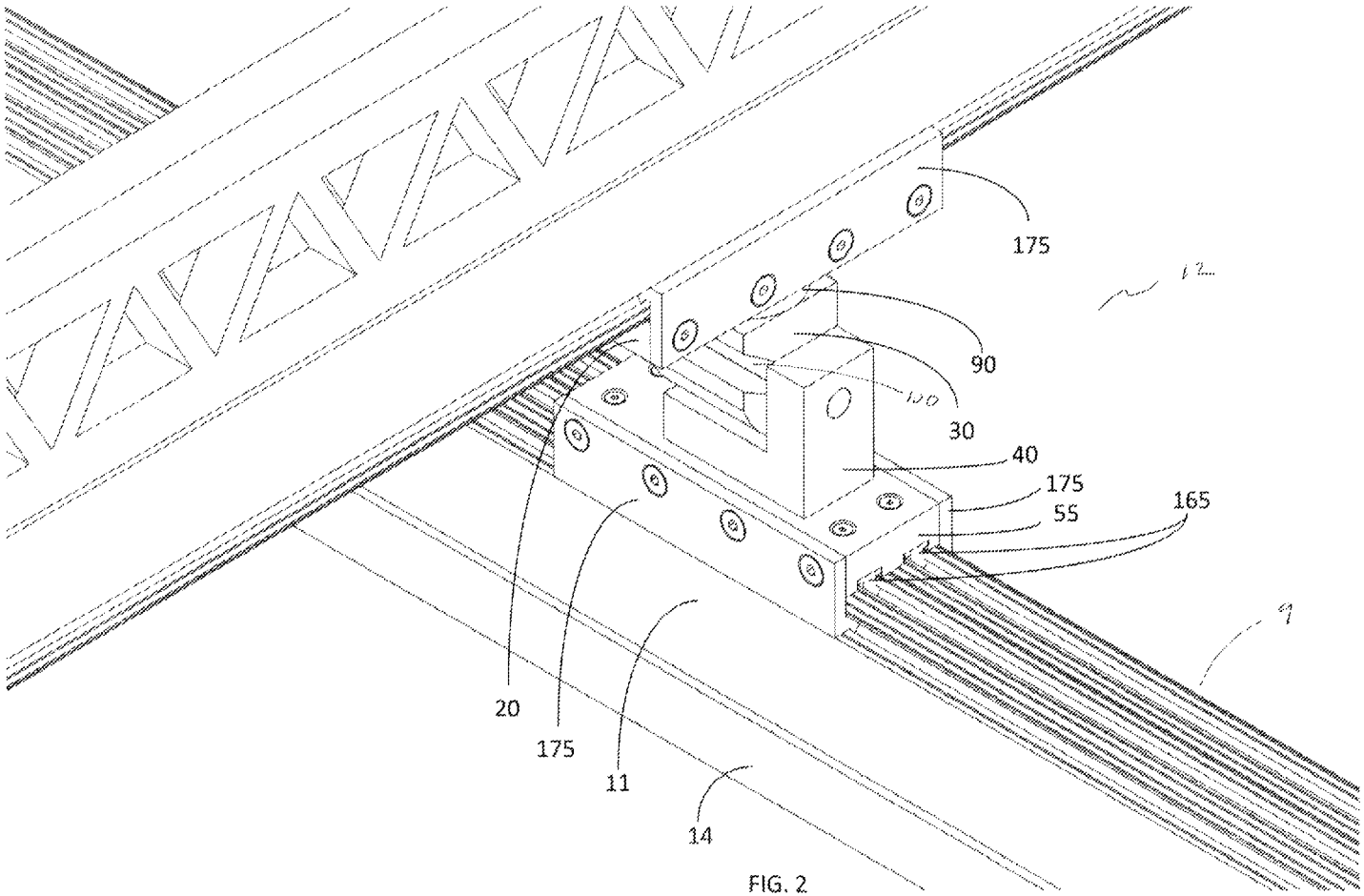
FIG. 2 is a view of Detail A in FIG. 1 showing a rotational hinge that provides freedom of motion for the screed bar.
Figure 3:
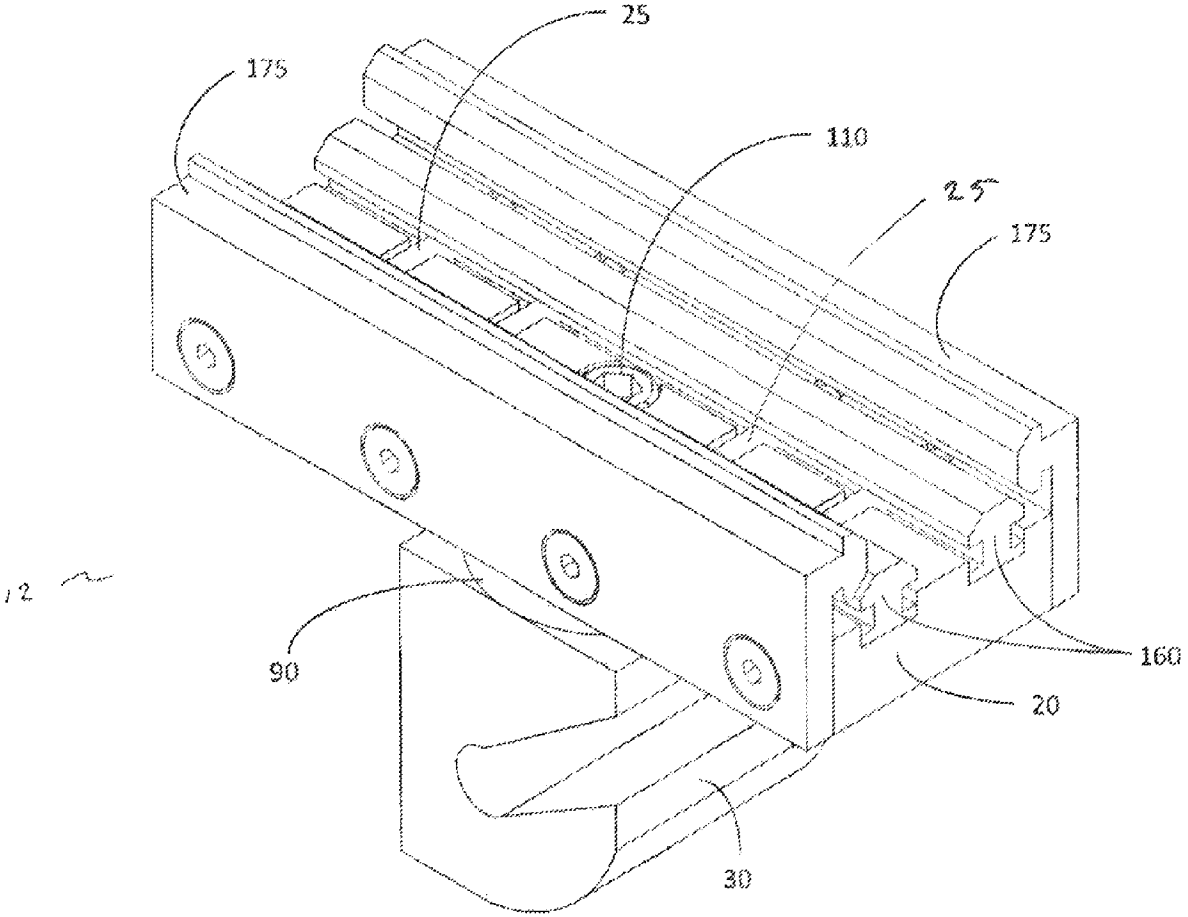
FIG. 3 is a detailed perspective view of the pivoting hinge.
Figure 5A:
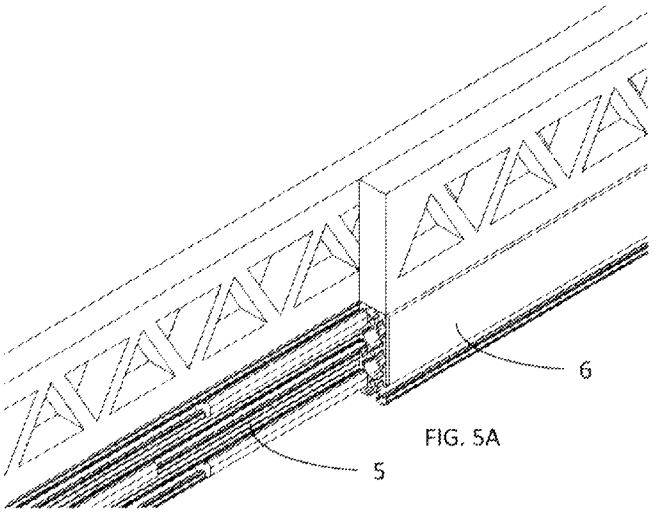
FIGS. 5*a* to 5*c* are perspective, exploded and cross sectional views of the slidable rails used in the screed system.
Figure 5B:
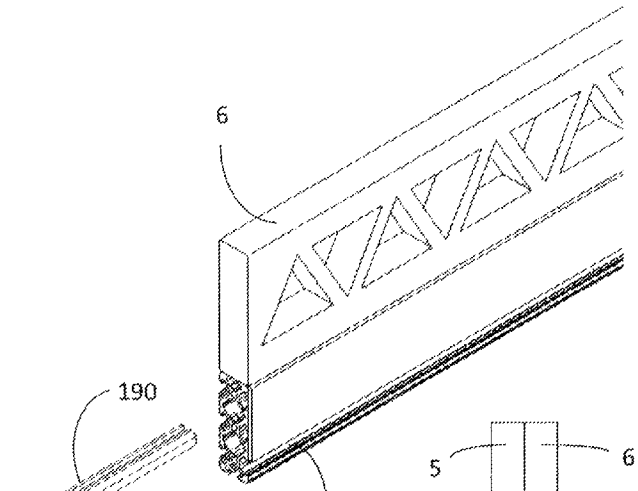
Figure 5C:
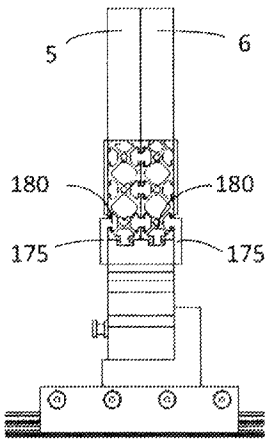
Figure 5:
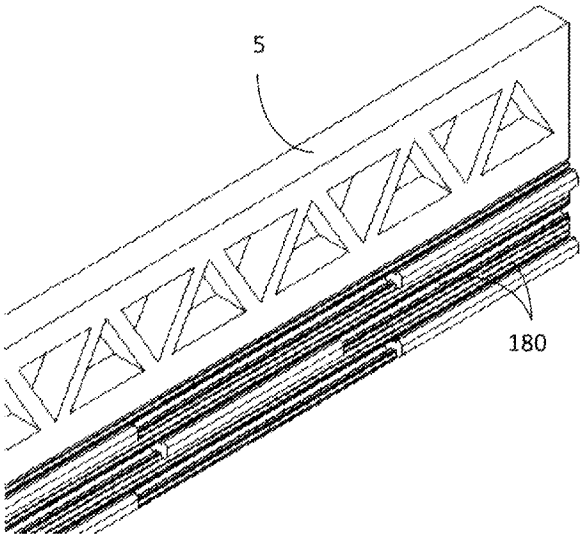

Rotational hinges 12, 13, as seen in FIGS. 2 and 3, extend downwardly from rail bars 5, 6, 7 or 8, and support screed bar 70 while allowing extension bars 10, 11 freedom of movement. Each rotational hinge 12, 13, includes a slidable rail head 20, which can be positioned by sliding head 20 along rail bars 5, 6, or 7, 8. Rotational hinge 12 also includes thrust bearing 90, the top portion of which is secured to rail head 20, and the bottom portion to female hinge 30. Rail head 20 is secured to rail bars 5, 6, 7, or 8 by pin 110, and inserts 160 are sized to slidably fit into grooves on the bottom of rail bars 5, 6, 7 or 8, and guide plate 175. Rollers 25, or alternatively bearings, can be used to assist rail head 20 in sliding along rail bars 5, 6, 7, or 8. Thrust bearing 90 allows main screed 9 to rotate around rotational hinges 12, 13. Female hinge 30 includes an elongated hook sized to hold and support pin 100 secured to male hinge 40, and female hinge 30 thereby supports male hinge 40. Alternate hinge arrangements are also available. Male hinge 40 is secured to screed head 55, which is maintained in place by inserts 165 on the top of main screed 9 which fit into slots on the bottom of screed head 55, allowing screed head 55 to be slidingly positioned on screed 9. Guide plates 175 are also used to hold screed head 55 in position.

As shown in FIGS. 5*a* to 5*d*, rail bars 5, 6 and 7, 8 are slidingly engaged with each other. Grooves 180 on each rail bar, rail bar 5 as represented in the figures, receive and hold an extension portion 190 of rail connector 185. The opposite extension 192 of rail connector 185 fit into grooves 180 on rail bar 6 thereby keeping the rails slidably connected. Rail connectors 185 are positioned at intervals along rail bars 5, 6. Alternatively, other means of maintaining rail bars 5, 6 and 7,8 slidably engaged may be used. Screw drives 16, 17 may be used to move rail bars 5 or 7 relative to rail bars 8, or 6, respectively. Main screed 9 may be slidingly attached to screed extensions 10, 11 using similar means. Locking pins (not shown) may be used to prevent screed 70 from extending or contracting involuntarily. Rollers (not shown) could also be used to allow the rails to more easily slide relative to one another.

For a user to move screed 70 they can pull down on handle 15 This pivots male hinge 40 upwards on pin 100, and blade 14 moves towards rail bars 6, 7, 8, 9, allowing screed 70 to move freely. When the handle 15 is returned to a lowered position, pin 100 will settle into female hinge 30 and maintain it in position approximately 90 degrees to the rail.

Screed bar 70 therefore has a wide range of motion. Screed bar 70 has an adjustable length. Screed bar 70 may move along one of or both rails 50, 60, and screed bar 70 may rotate around one of or both rotation hinges 12, 13.

Screed bar 70 is detachable from rotational hinges 12, 13 for portability and ease of transport and storage of screed system 100. Screed system 100 is thus a light weight and portable system that can be moved and operated by a single person.

Level heads 31 may be positioned on the top end of rail bars 5, 6, 7, and 8, and the middle of main screed bar 9. Heads 31 can transmit reading to level readout 22 positioned nearby or may be observed directly by a user.

Rails 50, 60 are elevated by four height adjustable stands 140, as shown in FIGS. 4*a* through 4*d*. Stands 140 include rod threaded screw 200 supporting threaded sleeve 103. Threaded sleeve 103 has extensions 105 extending therefrom to receive corresponding apertures in rail bars 5, 6, 7, or 8 and support such rail above the concrete being finished or levelled. Legs 300 support rod threaded screw 200. Handle 48 allows threaded screw 200 to rotate and adjust the height of rails 50, 60. Rails 50, 60 should be measured, for example, via level heads 31, to ensure they are at the proper level desired.

Rails 50, 60 may be supported by a reinforcement bar (not shown), which extends along the top of each rail bar 5, 6, 7, and 8. The reinforcement bar prevents rails 50, 60 from "sagging" or bending from the weight of screed bar 70.

To use screed system 10, a user first positions rails 50, 60 where desired and adjusts the height of rails 50, 60 using stands 140. After this, the user can level the concrete by moving the screed bar 70 along the concrete surface using handle 15, and lengthening and pivoting screed bar 70 as needed to adjust to the shape of the room or area being levelled.

The above-described embodiments have been provided as examples, for clarity in understanding the invention. A person of skill in the art will recognize that alterations, modifications and variations may be effected to the embodiments described above while remaining within the scope of the invention as defined by the claims appended hereto.

What is claimed is:

1. A screed system, comprising:

a first elevatable rail;

a second elevatable rail;

a screed bar positioned below the first and second elevatable rails and supported by the first and second elevatable rails by respective first and second rotatable hinges, each of said rotational hinges comprising a slidable rail head positionable along said first and second elevatable rails for movement of the screed bar along the first and second elevatable rails, said rail head supporting a thrust bearing having a female hinge, said female hinge configured to hold and support a male hinge for rotation of the screed bar relative to the first and second elevatable rails at both the respective first and second rotatable hinges, said male hinge secured to a screed head slidingly positionable along said screed bar; and a handle extending from said screed bar, said handle enabling a single user to rotate said screed bar relative to the first and second rails about an axis parallel to the screed bar.

2. The screed system of claim 1 wherein said screed bar has a rubber blade.

3. The screed system of claim 1 wherein said first elevatable rail has an adjustable length.

4. The screed system of claim 3 wherein said second elevatable rail has an adjustable length.

5. The screed system of claim 1 wherein said screed bar has an adjustable length.

6. The screed system of claim 3 wherein each of said first and second elevatable rails comprise first and second rail bars, each of said first rail bars adjacent to said second rail bar and moveable along said second rail bar.

7. The screed system of claim 5 wherein said screed bar comprises a main screed bar aligned with and adjacent to first and second extension screed bars, said first and second extension screed bars slideable along said main screed bar.

8. The screed system of claim 1 wherein said rail head is secured to said rail by a pin and inserts, said inserts sized to be insertable and supported by grooves on a bottom side of said rail.

9. The screed system of claim 1 wherein said rails further comprises a plurality of rollers to assist slidable movement of said rail head.

10. The screed system of claim 1 wherein each of said elevatable rails have a first end and a second end, each of said first ends and second ends supported by a height adjustable stand.

11. The screed system of claim 1 wherein said screed bar is detachable from said rotatable hinges.

12. The screed system of claim 1 wherein a plurality of level heads are positioned on said rails.

13. A screed system, comprising:

a first elevatable rail;

a second elevatable rail;

a screed bar positioned below the first and second elevatable rails and supported by the first and second elevatable rails by respective first and second rotatable hinges, each of said rotational hinges comprising a slidable rail head positionable along said first and second elevatable rails for movement of the screed bar along the first and second elevatable rails, said rail head supporting a thrust bearing having a female hinge, said female hinge configured to hold and support a male hinge for rotation of the screed bar relative to the first and second elevatable rails at both the respective first and second rotatable hinges, said male hinge secured to a screed head slidingly positionable along said screed bar; and a handle extending from said screed bar, said handle enabling a single user to horizontally rotate said screed bar relative to the first and second rails about a horizontal axis parallel to the screed bar.

* * * * *